US005278940A

United States Patent [19]

Müller

[11] Patent Number: 5,278,940

[45] Date of Patent: Jan. 11, 1994

[54] DEVICE UTILIZING A PTC RESISTOR FOR ELECTRICALLY HEATING FLOWING LIQUID OR GASEOUS MEDIA

[76] Inventor: Hermann-Frank Müller, Reichenhallerstr. 42, 8000 München 90, Fed. Rep. of Germany

[21] Appl. No.: 736,250

[22] Filed: Jul. 26, 1991

[51] Int. Cl.[5] ..... H05B 1/02; H05B 3/12; H05B 3/82; F24H 1/10

[52] U.S. Cl. ..... 392/485; 123/549; 219/206; 219/505; 219/530; 219/540; 219/541; 219/551; 338/22 R; 392/379; 392/396; 392/492; 392/502

[58] Field of Search ..... 392/485-496; 123/549, 557; 219/551, 206-207; 392/396-398, 502, 379; 383-385; 219/541, 530, 540, 504-505; 338/22D

[56] References Cited

U.S. PATENT DOCUMENTS

| | | | |
|---|---|---|---|
| 1,095,555 | 5/1914 | Crone | 392/488 |
| 1,220,508 | 3/1917 | Grimshaw et al. | 392/488 |
| 1,359,983 | 11/1920 | Grant | 392/489 X |
| 1,402,585 | 1/1922 | Epstein et al. | 219/207 |
| 1,463,133 | 7/1923 | Grant | 392/485 X |
| 1,484,616 | 2/1924 | Aske | 219/551 |
| 1,707,170 | 3/1929 | Miller | 392/396 |
| 3,828,161 | 8/1974 | Yamaguchi | 392/485 |
| 4,899,032 | 2/1990 | Schwarl et al. | 392/485 X |

FOREIGN PATENT DOCUMENTS

| | | | |
|---|---|---|---|
| 194507 | 9/1986 | European Pat. Off. | 392/485 |
| 1092646 | 11/1954 | France | 123/549 |
| 102534 | 12/1923 | Switzerland | 392/485 |
| 1089767 | 4/1984 | U.S.S.R. | 392/488 |

*Primary Examiner*—Anthony Bartis
*Attorney, Agent, or Firm*—Robert W. Becker & Associates

[57] ABSTRACT

A device for heating flowing liquid or gaseous media has a heating element including a PTC resistor arranged between a pair of perforated metallic bodies serving as power supply terminals for the resistor. The heating element is positioned inside a tubular housing defining a flow path for the medium to be heated and made of two mating housing parts, with the heating element extending across the flow path for flow of the medium through the perforations of the metallic bodies to transfer heat to the medium. A bracket on each metallic body fastens the heating element to the housing and is electrically connected to a contact on one end of a power supply cable molded as an integral part of one of the housing parts and terminating at its other end in an electrical plug outlet on the housing part connectable to a battery or electrical network.

11 Claims, 3 Drawing Sheets

DEVICE UTILIZING A PTC RESISTOR FOR ELECTRICALLY HEATING FLOWING LIQUID OR GASEOUS MEDIA

BACKGROUND OF THE INVENTION

The present invention relates to a device for heating flowing fluid or gaseous media. Fluid or gaseous media are used, for example, for the operation and lubrication of energy consuming machines and apparatus at temperatures, which often must be higher than the surrounding temperature. A heat exchanger is installed for this purpose.

A continuous flow heater is disclosed in DE-GM 79 16 927. It is used for electrically heating flowing media via thin cover tubes that are heated via heating elements. The cover tubes are surrounded by channels. This device is disposed in a two-part tubular housing. The channels have a relatively large cross-section and therefore the number of channels that may be placed about the cover tube is limited. The relatively large cross-section of the channels also requires a correspondingly long heating path for heating the medium that flows through. Furthermore, the number of components for this device is rather large.

These commonly known heat exchangers are relatively costly with respect to their acquisition and installation. They require a lot of space, and can often only be used, when the machinery or apparatus are in operation.

It is therefore an object of the present invention to provide a device for heating fluid or gaseous media, which may be inexpensively manufactured, which may be easily installed in any piece of machinery, which does not take up much space, and which may be operable when the respective piece of machinery is not running.

SUMMARY OF THE INVENTION

The device of the present invention is primarily characterized by a heating element in the form of a metal body made of a heat conducting material. The device has a tubular housing having two housing parts made of electrically insulting material, whereby the heating element is disposed in the housing. Two electrical cables are molded as an integral part of a first one of the housing parts, with a first end of the cables being provided with a contact for connecting with the heating element and with a second end of the cables being connected to a plug connection disposed at the first housing part. At least one collar ring is provided at a respective face of the housing for receiving pipe flanges for directly connecting inlet means and outlet means for the fluid and gaseous media to the housing.

The invention makes use of a heating element in the device , which meets the technical standard given by EP-A1 0194 507. When the heating element is installed according to the invention a device is created, which can be used advantageously in numerous areas, especially since for preheating a current from a network, but alternatively also from a battery may be used.

In a further embodiment of the present invention, the heating element is provided with metal brackets for fastening the heating element to the housing. The two housing parts are in the form of two half shells that are provided with respective recesses for receiving the brackets of the heating element. The recesses are cone-shaped and narrow in a direction away from a jointing plane of the housing.

In another embodiment, the contacts form the walls of the recesses of the first housing part. It is also possible, that the contacts are provided in the form of a plug that is insertable into an opening of the metal brackets.

Furthermore, the housing parts may be connected at a their jointing plane in a permanently fixed and sealed manner, or via a sealing means in a releasable and sealed manner.

In another embodiment of the present invention, two opposite faces of the housing are provided with a respective collar ring so that the media are flowing through the device in its longitudinal direction.

In a further embodiment, only one collar ring on one of the faces of housing is provided with two openings for receiving the pipe flanges, whereby an outlet line is molded into at least one of the housing halves such that the media pass the heating element before they are released through the outlet means. In this embodiment, the second face of the housing is closed off.

The outlet line may be in the form of annular lines that are arranged adjacent to the two faces of the housing with the heating element positioned therebetween. A respective first half of the annular lines are disposed in the first housing part and a respective second half of the annular lines in the second housing part. The annular lines are connected to one another, and the annular line that is adjacent to the second face is provided with openings that are uniformly spaced from one another and that open radially inwardly.

The device of the present invention may be provided with two plug connections, with a first one connecting to an electrical network and a second one connecting to a battery.

BRIEF DESCRIPTION OF THE DRAWINGS

Preferable embodiments of the invention will be explained with the aid of the drawings, in which.

DESCRIPTION OF PREFERRED EMBODIMENTS

Figure 1:
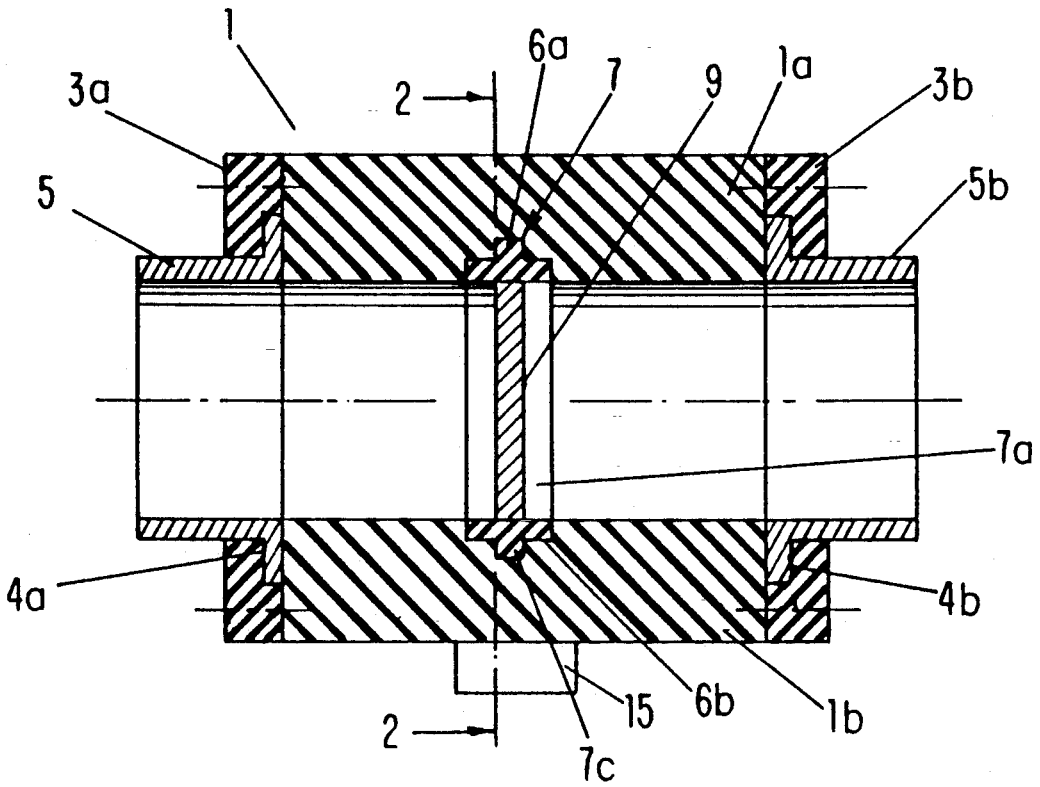
FIG. 1 shows a cross-section of the first device.

The device of FIG. 1 shows a housing with two housing halves 1*a* and 1*b*of any suitable electrically insulating material. The housing 1 is delimited with collar rings 3*a* or 3*b*, which are tightly screwed on or glued on in order to hold both housing halves 1*a* and 1*b* together.

In addition both collar rings 3*a*, 3*b* each have a recess 4*a*, 4*b* respectively, for insertion of a pipe flange tube 5*a*, 5*b* respectively, with the flange portion being turned toward the housing halves 1*a* and 1*b*. The pipe flanges 5*a* and 5*b* have a thread on their outer wall for the connection to inlet and outlet means of the fluid or gaseous medium. However, it is also possible to provide an inner instead of an outer thread.

Figure 2:
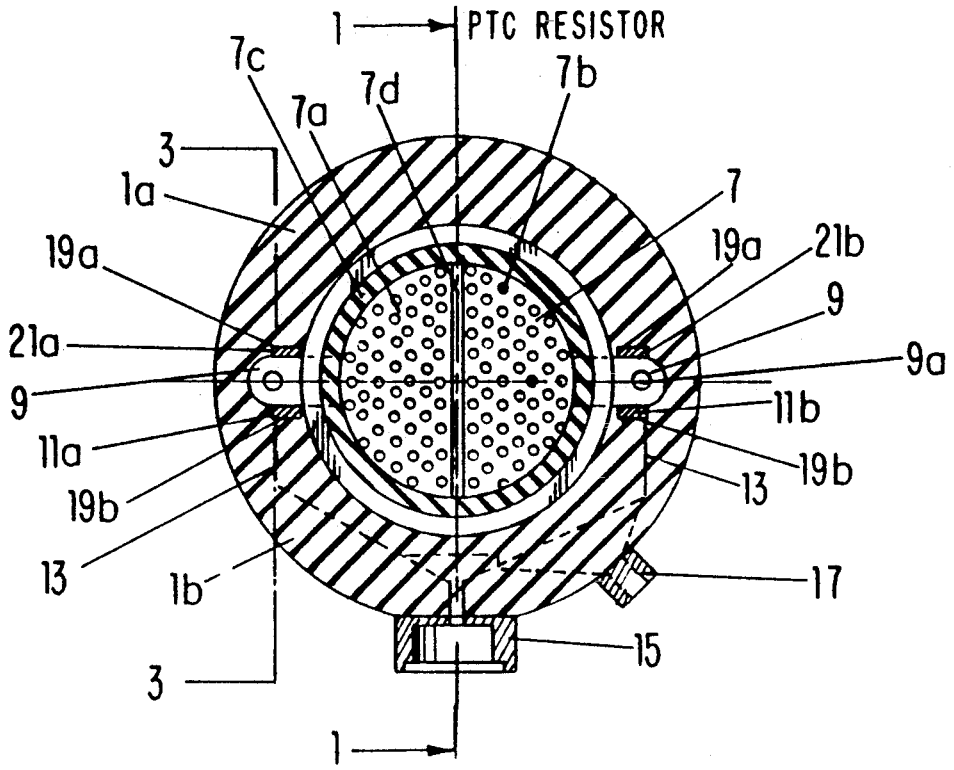
FIG. 2 is a view along the line 2—2 in FIG. 1.

Both housing halves 1*a* and 1*b* have grooves 6*a*, 6*b* which are arranged opposite from each other, for a known heating element according to EP A1 0 194 507. The heating element 7 as represented in the drawings is comprised of two individual bodies 7*a*, 7*b* of a good heat-conducting material arranged on opposite sides of a PTC resistor 7*d* so as to be in direct electrical contact with the PTC resistor 7*d*. Each individual body 7*a* , 7*b* is a perforated metallic body provided with a current supply bracket 9 that serves as a current supply means for the PTC resistor 7*d*. An enclosure 7*c* of an insulating material encloses the bodies 7*a*, 7*b* and the interposed PTC resistor 7*d*. The current supply brackets extend through the enclosure 7*c*. The heating element 7 rests firmly in U-shaped metal pockets 11*a*, 11*b* respectively (see FIGS. 2 and 3). The current supply brackets 9 extend laterally from the heating element 7. These pockets 11*a*, 11*b* are made of a metal which conducts electric current well, for example, copper, and are furthermore tightly secured in respective recesses 19*a*, 19*b* of the housing half 1*a*, 1*b*. Cables 13 are installed at the pockets 11*a* and 11*b* for conducting electric current, which cables are connected to electrical outlets 15 (current from a network) or 17 (current from a battery) (see FIG. 2), and which are fixedly connected to the pockets 11*a* and 11*b* of the receiving housing half 1*b*. Cables 13 are fixedly connected together with the pockets 11*a* and 11*b* during manufacturing of the respective housing half 1*b*, for example, by casting or molding.

Figure 2A:
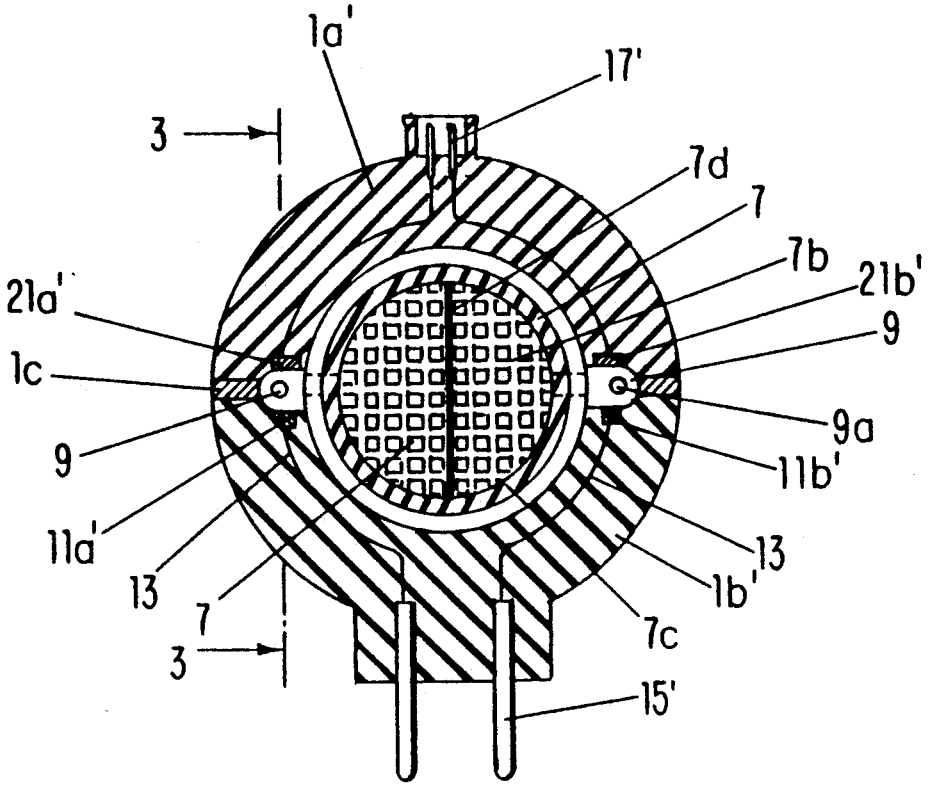
FIG. 2*a* shows a view according to FIG. 2 for an embodiment having a gasket positioned between the housing halves.

FIG. 2*a* shows a further embodiment in which the two housing halves 1*a*', 1*b*' are connected to one another in a releasable and sealed manner with a gasket 1*c*. The heating element 7 comprised of the parts 7*a*, 7*b*, 7*c*, 7*d* is identical to the embodiment shown in FIG. 2. An electrical connector 15' to be connected to a current supply from a network and, as an alternative, a connector 17' to be connected to a battery are shown.

Figure 3:
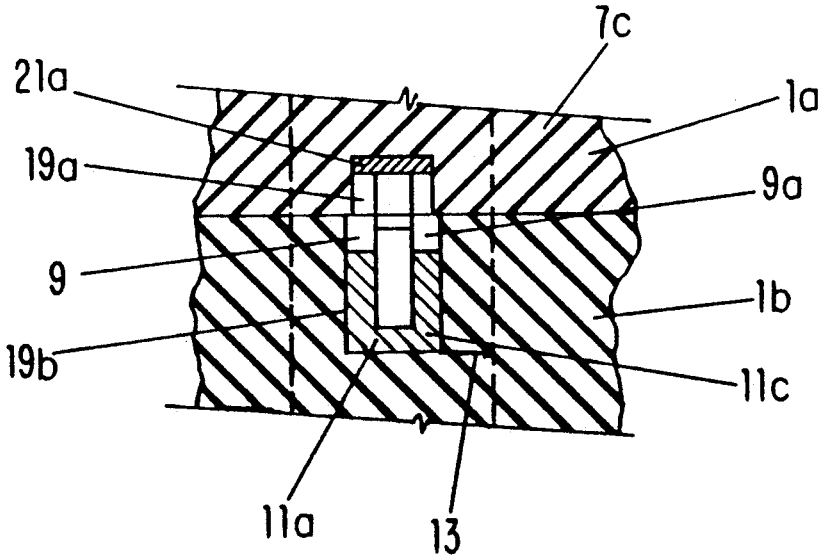
FIG. 3 is a view along the line 3—3 in FIG. 2, shown enlarged.
Figure 3A:
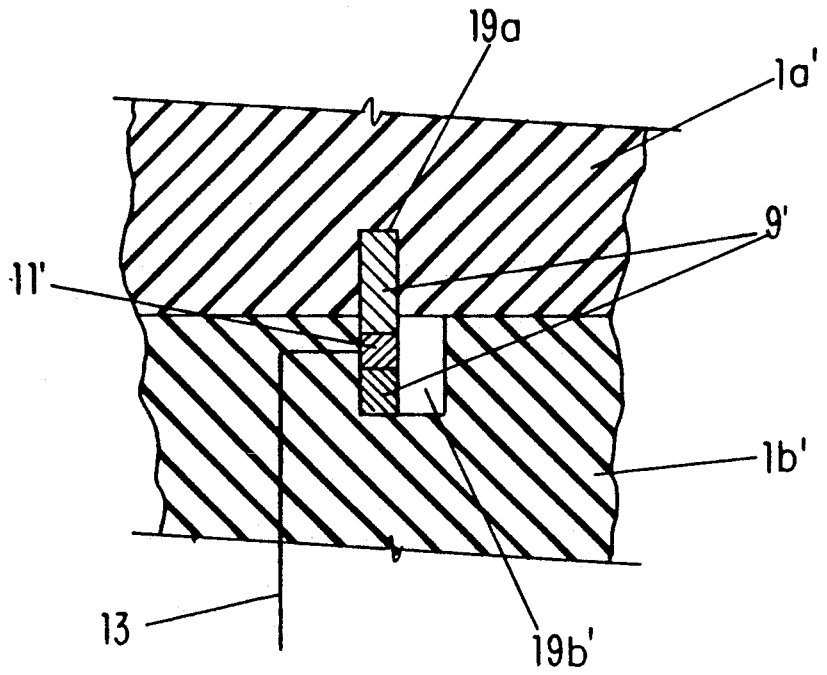
FIG. 3*a* shows a view according to FIG. 3 for a different embodiment in which the contacts are in the form of a plug.

According to FIG. 3, the pockets 11*a* and 11*b* have a pocket bottom which has a slightly tapered slit 11*c* for insertion of the metal brackets 9, which are tapered in the same manner and direction. During the installation of heating element 7 the housing presses onto a metal bracket 9 with its upper housing half la via pressure plates 21*a*, 21*b* that are installed on the bottom of the proper recess 19*a* or 19*b*. Thereby, the tapered bracket 9 is inserted into the tapered slit 11*c* of the pockets 11*a*, 11*b* respectively. Thus, a good conducting connection between heating element 7 and pockets 11*a*, 11*b*, respectively, is achieved. Only thereafter, by installation of the collar rings 3*a* and 3*b*, both housing halves 1*a* and 1*b* will be connected tightly with each other. It is within the skills of the designing engineer to determine how to tightly assemble both housing halves 1*a* and 1*b*. This may be achieved by gluing, by sealing, by insertion of a gasket, or any other means. FIG. 3*a* shows an alternative metal bracket 9' and contact 11'. The bracket 9 is positioned in the recesses 19*a*', 19*b*' and the contact 11' in the form of a plug is introduced into the hole of the bracket 9'.

Figure 4:
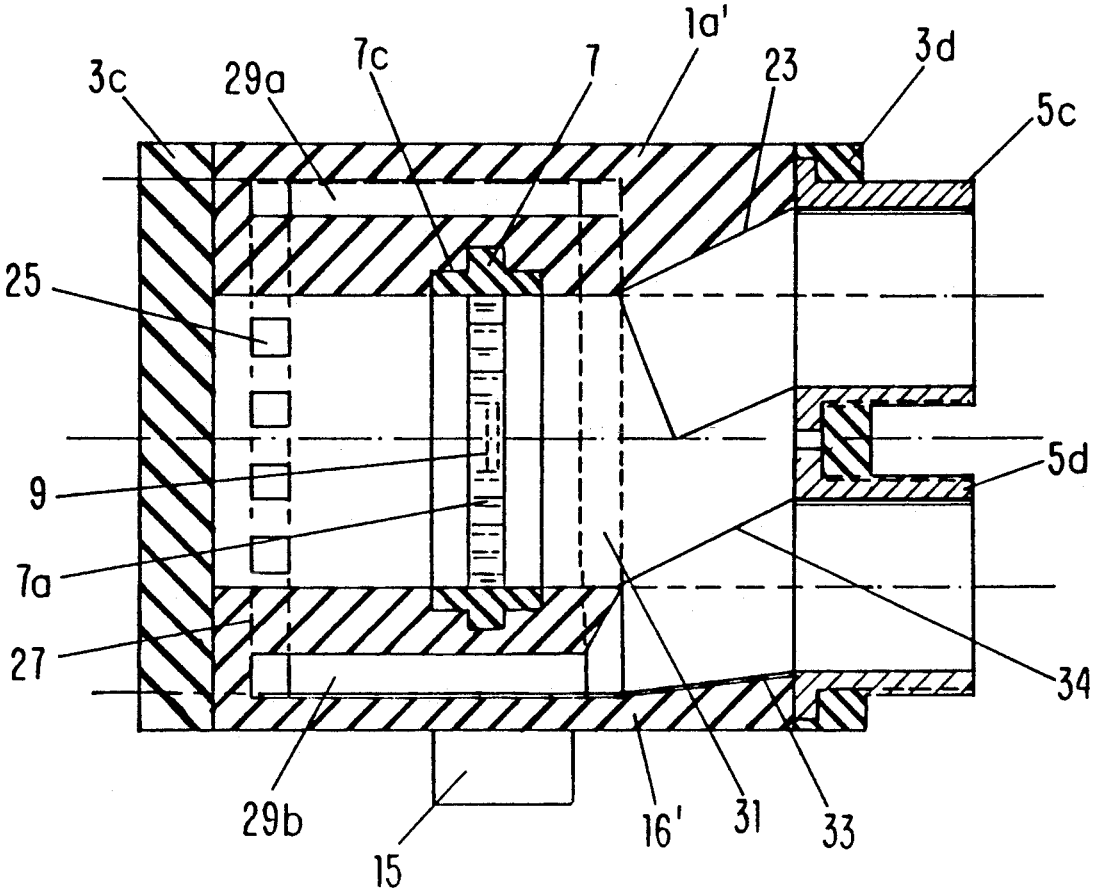
FIG. 4 shows a section of a second embodiment.

FIG. 4 shows a design variation. While it is irrelevant in a device according to FIG. 1 to 3, which one of the pipe flanges 5*a* or 5*b* serves as an inlet and which as an outlet for the flowing media, in a device according to FIG. 4 it is necessary to take into consideration by which means the flowing medium is forced through the device, i.e. by pressure or suction. Due to the laws of flow-dynamics it seems to be advantageous, that a pressurized medium enter the device according to FIG. 4 at the upper connection 5*c*, while a media sucked through the device should leave the device through the connection 5*d*. Accordingly, the sucked medium enters the device by connection 5*c*. A tubular sheet metal deflector 23 guides the medium in the direction to heating element 7. The medium passes through a number of openings 25 into an annular channel 27. At least one channel 29*a*, 29*b* leads from the annular channel 27 in an axial direction of the device to an additional annular channel 31, from which the medium passes over a tubular metal sheet deflector 34 to an outlet 5*d* where it leaves the device.

With this variation both outlets 5*c* and 5*d* are provided at the same collar ring 3*b*, while the collar ring 3*c* has no opening for the medium. The remaining parts of the device are identical to the parts shown in FIGS. 1 to 3.

In both embodiments the housing is divided in an axial direction, as described previously.

Of course, it is also possible to divide the housing vertically to the axis, whereby it is necessary to change the grooves for the heating element in the two housing halves accordingly. In order to provide the pockets 11*a* and 11*b* as well as the entire electrical means in only one housing half, it is necessary for both housing halves to have a step along the jointing plane at the level of the heating element 7. Finally it is possible to use a plug connection for connecting the electric cables to the heating element instead of using the pockets made out of electrically conducting material for this purpose. The plug connections are inserted into the opening 9*a* of the metal brackets 9 of the heating element 7.

The present invention is, of course, in no way restricted to the specific disclosure of the specification and drawings, but also encompasses any modifications within the scope of the appended claims.

What I claim is:

1. A device for electrically heating fluid and gaseous media, comprising:

a heating element comprised of a resistor and a pair of metallic bodies with perforations, said resistor arranged between said metallic bodies, with said metallic bodies serving as terminals for supplying power to said resistor;

a tubular housing defining a fluid flow path for fluid flow of the fluid having two housing parts made of electrically insulating material, said heating element positioned inside said housing and extending across said fluid flow path for fluid flow through said perforations for supplying heat to the flowing fluid;

said metallic bodies of said heating element each having a metallic bracket for fastening said heating element to said housing;

two electrical cables that are molded as an integral part of a first one of said housing parts, with a respective end of said cables having a contact, said contact being electrically connected to a respective one of said metallic bodies, and with a respective second end of said cables being connected to at least one plug connection attached to said first housing part; and at least one collar ring connected to a respective face of said housing for receiving pipe flanges for directly connecting inlet means and outlet means for the fluid and gaseous media to said fluid flow path.

2. A device according to claim 1, wherein said two housing parts are in the form of two half shells that are provided with respective recesses for receiving said brackets of said heating element.

3. A device according to claim 2, wherein said recesses are tapered and narrow in a direction away from a jointing plane of said housing.

4. A device according to claim 2, wherein said metal brackets are electrically connected to respective ones of said metallic bodies and said contacts form walls of said recesses of said first housing part.

5. A device according to claim 1, wherein said metal brackets are electrically connected to respective ones of said metallic bodies and said contacts are provided in the form of a plug that is insertable into an opening of said metal brackets.

6. A device according to claim 1, wherein said housing parts are connected at a jointing plane thereof in a permanently fixed and sealed manner.

7. A device according to claim 1, wherein said housing parts are connected at a jointing plane thereof via a sealing means in a releasable and sealed manner.

8. A device according to claim 1, wherein two opposite ones of said faces of said housing are provided with a respective one of said at least one collar ring so that the media are flowing through said device in a longitudinal direction thereof.

9. A device according to claim 1, wherein said at least one collar ring on a first one of said faces of said housing is provided with two openings for receiving said pipe flanges, whereby an outlet channel is molded into at least one of said housing halves such that the media pass said heating element before being released through said outlet means, and whereby a second one of said faces of said housing is closed off.

10. A device according to claim 9, wherein said outlet channel is in the form of annular channels that are arranged adjacent to said first and said second faces of said housing with said heating element positioned therebetween, with a respective first half of said annular channels disposed in first one of said housing parts and a respective second half of said annular channels in a second one of said housing parts, whereby said annular channels are connected to one another, and whereby one of said annular channels that is adjacent to said second face is provided with openings that are uniformly spaced from one another and that open radially inwardly.

11. A device according to claim 1, wherein said housing is provided with two said plug connections, with a first one thereof connecting to an electrical network and a second one thereof connecting to a battery.

* * * * *